US009922753B1

(12) United States Patent
Cook

(10) Patent No.: US 9,922,753 B1
(45) Date of Patent: Mar. 20, 2018

(54) COMMUNICATION CABLES WITH SEPARATORS HAVING BRISTLES

(71) Applicant: Superior Essex International LP, Atlanta, GA (US)

(72) Inventor: Thomas Christopher Cook, Woodstock, GA (US)

(73) Assignee: Superior Essex International LP, Atlanta, GA (US)

( * ) Notice: Subject to any disclaimer, the term of this patent is extended or adjusted under 35 U.S.C. 154(b) by 0 days.

(21) Appl. No.: 15/371,292

(22) Filed: Dec. 7, 2016

(51) Int. Cl.

| | |
|---|---|
| ***H01B 11/04*** | (2006.01) |
| ***H01B 11/08*** | (2006.01) |
| ***H01B 9/02*** | (2006.01) |
| ***H01B 11/06*** | (2006.01) |
| *H01B 7/282* | (2006.01) |
| *H01B 7/295* | (2006.01) |
| *H01B 7/17* | (2006.01) |
| *H01B 9/00* | (2006.01) |
| *H01B 7/00* | (2006.01) |
| *H01B 7/28* | (2006.01) |
| *H01B 7/18* | (2006.01) |
| *H01B 7/04* | (2006.01) |

(52) U.S. Cl.
CPC ..... *H01B 11/04* (2013.01); *H01B 9/028* (2013.01); *H01B 11/06* (2013.01); *H01B 11/08* (2013.01); *H01B 7/00* (2013.01); *H01B 7/041* (2013.01); *H01B 7/17* (2013.01); *H01B 7/182* (2013.01); *H01B 7/28* (2013.01); *H01B 7/282* (2013.01); *H01B 7/295* (2013.01); *H01B 9/00* (2013.01)

(58) Field of Classification Search
CPC ..... H01B 11/04; H01B 11/06; H01B 11/08; H01B 7/17; H01B 7/282; H01B 7/295; H01B 7/009; H01B 7/28; H01B 7/041; H01B 7/182; H01B 9/00; H01B 9/028
See application file for complete search history.

(56) References Cited

U.S. PATENT DOCUMENTS

| | | | | |
|---|---|---|---|---|
| 2007/0102188 | A1* | 5/2007 | Glew | H01B 7/295 174/113 C |
| 2007/0144762 | A1* | 6/2007 | Stutzman | H01B 11/06 174/113 C |
| 2007/0193769 | A1* | 8/2007 | Clark | H01B 11/06 174/113 R |
| 2010/0181093 | A1* | 7/2010 | Wiekhorst | H01B 7/184 174/113 R |
| 2015/0318075 | A1* | 11/2015 | Heffner | H01B 3/301 174/116 |

* cited by examiner

*Primary Examiner* — Ishwarbhai B Patel
*Assistant Examiner* — Paresh Paghadal

(57) ABSTRACT

A cable may include a plurality of twisted pairs of individually insulated conductors and a separator positioned between the twisted pairs. The separator may include a longitudinally extending spine positioned between the plurality of twisted pairs, and a plurality of bristles may radially extend from the spine. A first portion of the bristles may extend between one or more sets of adjacent twisted pairs, and a second portion of the bristles may be compressed towards the spine by one or more of the plurality of twisted pairs. Additionally, a jacket may be formed around the twisted pairs and the separator.

20 Claims, 6 Drawing Sheets

COMMUNICATION CABLES WITH SEPARATORS HAVING BRISTLES

TECHNICAL FIELD

Embodiments of the disclosure relate generally to communication cables and, more particularly, to communication cables incorporating separators that include a plurality of bristles or similar extensions.

BACKGROUND

A wide variety of different types of cables are utilized to transmit power and/or communications signals. In certain types of cables, it is desirable to provide separation for internal cable components. For example, certain cables make use of multiple twisted pairs of conductors to communicate signals. In each pair, the wires are twisted together in a helical fashion to form a balanced transmission line. When twisted pairs are placed in close proximity, such as within the core of a cable, electrical energy may be transferred from one pair of the cable to another pair. Such energy transfer between pairs is undesirable and is referred to as crosstalk. Crosstalk causes interference to the information being transmitted through the twisted pairs and can reduce the data transmission rate and cause an increase in bit rate error. Interlinking typically occurs when two adjacent twisted pairs are pressed together, and interlinking can lead to an increase in crosstalk among the wires of adjacent twisted pairs.

In order to improve crosstalk performance, separators (also referred to as separation fillers, fillers, interior supports, or splines) have been inserted into many conventional cables. These separators serve to separate adjacent twisted pairs and limit or prevent interlinking of the twisted pairs. However, many conventional separators are often formed as preformed structures, such as preformed cross-fillers, that have relatively limited flexibility. Alternatively, relatively flat tape structures have been utilized that bisect a cable core and do not provide separation between each set of adjacent twisted pairs. In the event that a tape structure is folded in order to alter its cross-sectional shape (e.g., to form a folded cross-filler, etc.), the flexibility of the separator is limited and an amount of required material is increased. Accordingly, there is an opportunity for improved separator structures and cables incorporating the separators.

BRIEF DESCRIPTION OF THE DRAWINGS

The detailed description is set forth with reference to the accompanying figures. In the figures, the left-most digit(s) of a reference number identifies the figure in which the reference number first appears. The use of the same reference numbers in different figures indicates similar or identical items; however, various embodiments may utilize elements and/or components other than those illustrated in the figures. Additionally, the drawings are provided to illustrate example embodiments described herein and are not intended to limit the scope of the disclosure.

DETAILED DESCRIPTION

Figure 1:
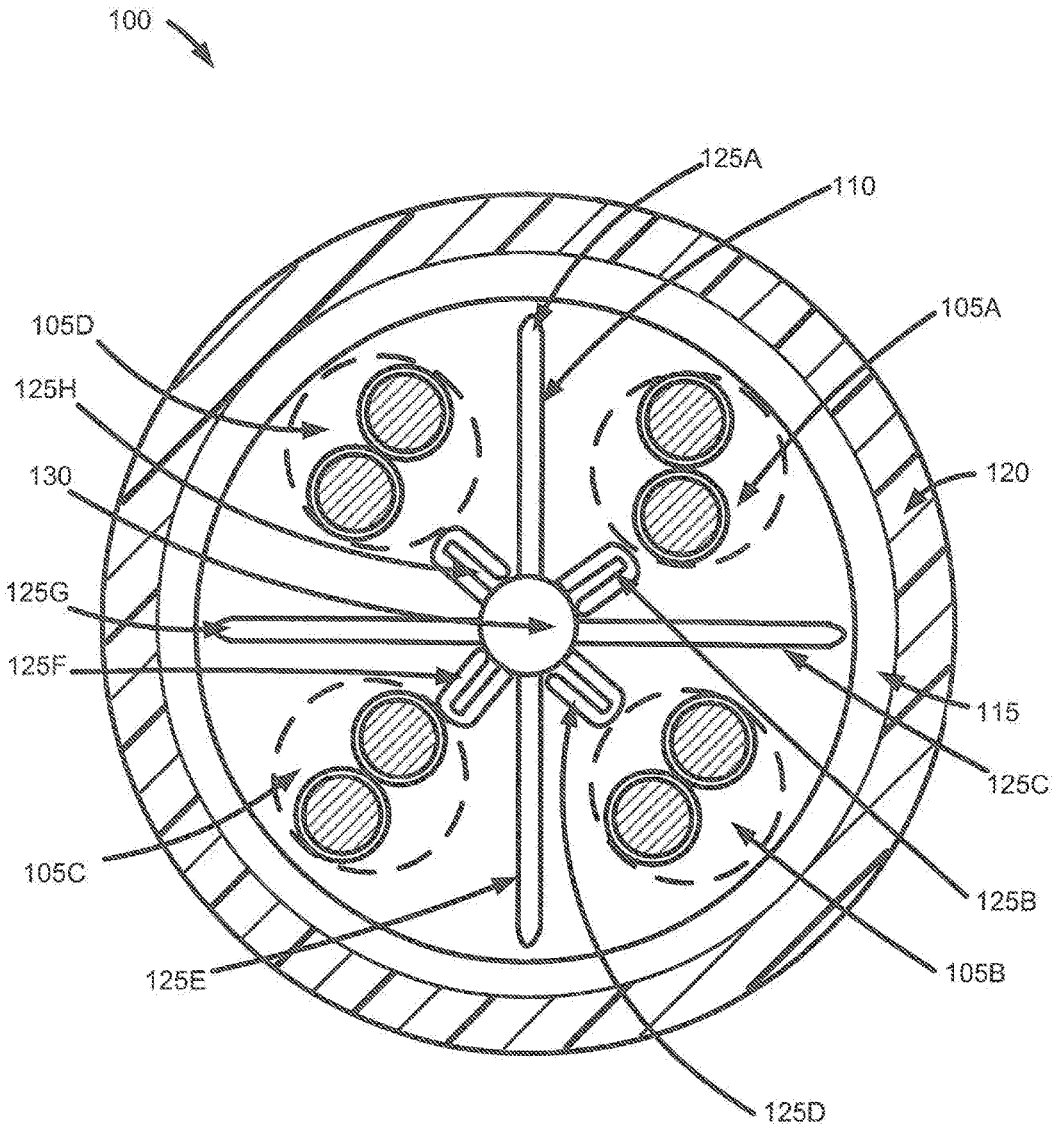
FIG. 1 is a cross-sectional view of an example twisted pair cable incorporating a separator that includes a plurality of bristles or extensions projecting from a spine, according to an illustrative embodiment of the disclosure.

Various embodiments of the present disclosure are directed to twisted pair communication cables that incorporate separators including a plurality of bristles or other suitable extensions that project from a central spine. In one example embodiment, a cable may include a plurality of longitudinally extending twisted pairs of individually insulated conductors and a jacket or other suitable layer (e.g., a shield layer, etc.) formed around the plurality of twisted pairs. Additionally, a separator may be positioned between the plurality of twisted pairs. The separator may include a central spine or central portion, and a plurality of bristles, filaments, or other extensions may radially project from the spine. According to an aspect of the disclosure, a first portion of the bristles may include bristles that respectively extend between one or more sets of adjacent twisted pairs, thereby providing separation between the adjacent twisted pairs. A second portion of the bristles may include bristles that are respectively compressed by one or more of the twisted pairs back towards the spine, thereby providing central core separation for the twisted pairs. In some cases, the compressed bristles may exhibit a spring action that enhances the central core separation.

For purposes of this disclosure, a bristle or extension may include any suitable projection that radially extends from a spine and that may be compressed, bent, or folded in an inward motion in the event that it comes into contact with a twisted pair and is not able to project between two adjacent twisted pairs. In various embodiments, a bristle may be alternatively referred to as a filament, fiber, extension, extending portion, or a projection. A bristle may be formed with any suitable dimensions, such as any suitable cross-sectional shape, cross-sectional area, and/or length (i.e., length of projection from the spine). As explained in greater detail below, a bristle may be formed with a wide variety of suitable dimensions, such as a wide variety of suitable cross-sectional shapes, cross-sectional areas, and/or lengths (e.g., a length that the bristle extends from a spine). Additionally, a bristle may be formed from a wide variety of suitable materials and/or combinations of materials including, but not limited to, dielectric materials (e.g., polymeric materials, etc.), conductive materials, semi-conductive materials, etc. In certain embodiments, a bristle may be formed and/or sized such that it provides desirable separation when extending between adjacent pairs while also being flexible enough to be compressed towards the spine when it does not extend between adjacent pairs.

A spine may also be formed with a wide variety of suitable dimensions, such as a wide variety of suitable cross-sectional shapes, cross-sectional areas, and/or other dimensions. In certain embodiments, a spine can be formed from a single longitudinally continuous section that extends approximately an entire length of a cable. In other embodiments, as explained in greater detail below, a spine may be formed from a plurality of longitudinally arranged discrete or separate portions, such as a plurality of sections or portions that are positioned end to end along a longitudinal length of a cable. A spine may also be formed from a wide variety of suitable materials and/or combinations of materials including, but not limited to, dielectric materials (e.g., polymeric materials, etc.), conductive materials, semi-conductive materials, etc.

As desired in various embodiments, bristles may respectively extend from a spine in any suitable direction and/or plurality of directions. Additionally, bristles may be positioned with any suitable density relative to a given surface area of the spine. In certain embodiments, at a plurality of cross-sectional locations along the longitudinal length of the spine, such as a plurality of longitudinally spaced locations, a plurality of bristles may respectively extend in a plurality of different directions. In other embodiments, bristles may extend from a spine in one or more spiral patterns along the longitudinal length. A spiral or other suitable pattern may be formed with any desired period or lay. Additionally, in certain embodiments, a separator may be twisted with any suitable period or lay prior to being positioned between a plurality of twisted pairs. As a result of the twisting, bristles may project from the separator in a plurality of various directions relative to their pre-twisted positions. For example, a separator may be formed with bristles extending in a single direction (or a finite number of directions) and, when the spine of the separator is twisted, the bristles may be arranged in a spiral pattern. In other embodiments, a separator may be positioned between a plurality of twisted pairs without being twisted. Indeed, a wide variety of suitable bristle arrangements may be utilized as explained in greater detail below.

In certain embodiments, a separator with bristles extending from a central spine may resemble a spout brush, bore brush, or similar structure. Additionally, as a result of incorporating a separator with a plurality of bristles extending from a spine into a cable, desired spacing or separation may be provided between adjacent twisted pairs in order to reduce crosstalk. However, the resulting separator may be formed with less overall material than conventional separators, thereby reducing the overall cost of the cable. For example, a central spine portion may be formed with a relatively small cross-section because compressed bristles may provide adequate separation between twisted pairs that are diagonally positioned relative to one another. As another example, bristles may be longitudinally positioned along the spine in a spaced manner, thereby utilizing less material than conventional separators that include longitudinally continuous fins or prongs. A bristle separator may also provide enhanced flexibility relative to conventional separator structures.

Embodiments of the disclosure now will be described more fully hereinafter with reference to the accompanying drawings, in which certain embodiments of the disclosure are shown. This invention may, however, be embodied in many different forms and should not be construed as limited to the embodiments set forth herein; rather, these embodiments are provided so that this disclosure will be thorough and complete, and will fully convey the scope of the invention to those skilled in the art. Like numbers refer to like elements throughout.

FIG. 1 illustrates a cross-sectional view of an example twisted pair cable 100 incorporating a separator that includes a plurality of bristles or extensions projecting from a spine, according to an illustrative embodiment of the disclosure. The cable 100 may include a plurality of twisted pairs 105A-D, a separator 110 positioned between the plurality of twisted pairs 105A-D, one or more optional shield layers (e.g., individual shields respectively formed around each of the twisted pairs, an overall shield 115 formed around the plurality of twisted pairs 105A-D and the separator 110, etc.), and a jacket 120 formed around the plurality of twisted pairs 105A-D and the separator 110. The cable 100 is illustrated as a twisted pair communications cable; however, other types of cables may be utilized, such as composite or hybrid cables that include a combination of twisted pairs and other transmission media (e.g., optical fibers, etc.). Indeed, suitable cables may include any number of transmission media including but not limited to one or more twisted pairs, optical fibers, coaxial cables, and/or power conductors. Additionally, embodiments of the disclosure may be utilized in association with horizontal cables, vertical cables, flexible cables, equipment cords, cross-connect cords, plenum cables, riser cables, or any other appropriate cables. Each of the components of the cable 100 are described in greater detail below.

Although four twisted pairs 105A, 10513B, 105C, 105D are illustrated in FIG. 1, any other suitable number of pairs may be utilized. As desired, the twisted pairs 105A-D may be twisted or bundled together and/or suitable bindings may be wrapped around the twisted pairs 105A-D. In other embodiments, multiple grouping of twisted pairs may be incorporated into a cable, and any of the groupings may include a respective separator. Additionally, as desired, the multiple groupings may be twisted, bundled, or bound together.

Each twisted pair (referred to generally as twisted pair 105) may include two electrical conductors, each covered with suitable insulation. Each twisted pair 105 can carry data or some other form of information at any desirable frequency, such as a frequency that permits the overall cable 100 to carry data at approximately 600 MHz or greater. As desired, each of the twisted pairs may have the same twist lay length or alternatively, at least two of the twisted pairs may include a different twist lay length. For example, each twisted pair may have a different twist rate. The different twist lay lengths may function to reduce crosstalk between the twisted pairs. A wide variety of suitable twist lay length configurations may be utilized. In certain embodiments, the differences between twist rates of twisted pairs that are circumferentially adjacent one another (for example the twisted pair 105A and the twisted pair 105B) may be greater than the differences between twist rates of twisted pairs that are diagonal from one another (for example the twisted pair 105A and the twisted pair 105C). As a result of having similar twist rates, the twisted pairs that are diagonally disposed can be more susceptible to crosstalk issues than the twisted pairs 105 that are circumferentially adjacent; however, the distance between the diagonally disposed pairs may limit the crosstalk.

Additionally, in certain embodiments, each of the twisted pairs 105A-D may be twisted in the same direction (e.g., clockwise, counter clockwise). In other embodiments, at least two of the twisted pairs 105A-D may be twisted in opposite directions. Further, as desired in various embodiments, one or more of the twisted pairs 105A-D may be twisted in the same direction as an overall bunch lay of the combined twisted pairs. For example, the conductors of each of the twisted pairs 105A-D may be twisted together in a given direction. The plurality of twisted pairs 105A-D may then be twisted together in the same direction as each of the individual pair's conductors. In other embodiments, at least one of the twisted pairs 105A-D may have a pair twist direction that is opposite that of the overall bunch lay. For example, all of the twisted pairs 105A-D may have pair twist directions that are opposite that of the overall bunch lay.

The electrical conductors of a twisted pair 105 may be formed from any suitable electrically conductive material, such as copper, aluminum, silver, annealed copper, copper clad aluminum, gold, a conductive alloy, etc. Additionally, the electrical conductors may have any suitable diameter, gauge, cross-sectional shape (e.g., approximately circular, etc.) and/or other dimensions. Further, each of the electrical conductors may be formed as either a solid conductor or as a conductor that includes a plurality of conductive strands that are twisted together.

The twisted pair insulation may include any suitable dielectric materials and/or combination of materials, such as one or more polymeric materials, one or more polyolefins (e.g., polyethylene, polypropylene, etc.), one or more fluoropolymers (e.g., fluorinated ethylene propylene ("FEP"), melt processable fluoropolymers, MFA, PFA, ethylene tetrafluoroethylene ("ETFE"), ethylene chlorotrifluoroethylene ("ECTFE"), etc.), one or more polyesters, polyvinyl chloride ("PVC"), one or more flame retardant olefins (e.g., flame retardant polyethylene ("FRPE"), flame retardant polypropylene ("FRPP"), a low smoke zero halogen ("LSZH") material, etc.), polyurethane, neoprene, cholorosulphonated polyethylene, flame retardant PVC, low temperature oil resistant PVC, flame retardant polyurethane, flexible PVC, or a combination of any of the above materials. Additionally, in certain embodiments, the insulation of each of the electrical conductors utilized in the twisted pairs 105A-D may be formed from similar materials. In other embodiments, at least two of the twisted pairs may utilize different insulation materials. For example, a first twisted pair may utilize an FEP insulation while a second twisted pair utilizes a non-FEP polymeric insulation. In yet other embodiments, the two conductors that make up a twisted pair 105 may utilize different insulation materials.

In certain embodiments, the insulation may be formed from multiple layers of one or a plurality of suitable materials. In other embodiments, the insulation may be formed from one or more layers of foamed material. As desired, different foaming levels may be utilized for different twisted pairs in accordance with twist lay length to result in insulated twisted pairs having an equivalent or approximately equivalent overall diameter. In certain embodiments, the different foaming levels may also assist in balancing propagation delays between the twisted pairs. As desired, the insulation may additionally include other materials, such as a flame retardant materials, smoke suppressant materials, etc.

The jacket 120 may enclose the internal components of the cable 100, seal the cable 100 from the environment, and provide strength and structural support. The jacket 120 may be formed from a wide variety of suitable materials and/or combinations of materials, such as one or more polymeric materials, one or more polyolefins (e.g., polyethylene, polypropylene, etc.), one or more fluoropolymers (e.g., fluorinated ethylene propylene ("FEP"), melt processable fluoropolymers, MFA, PFA, ethylene tetrafluoroethylene ("ETFE"), ethylene chlorotrifluoroethylene ("ECTFE"), etc.), one or more polyesters, polyvinyl chloride ("PVC"), one or more flame retardant olefins (e.g., flame retardant polyethylene ("FRPE"), flame retardant polypropylene ("FRPP"), a low smoke zero halogen ("LSZH") material, etc.), polyurethane, neoprene, cholorosulphonated polyethylene, flame retardant PVC, low temperature oil resistant PVC, flame retardant polyurethane, flexible PVC, or a combination of any of the above materials. The jacket 120 may be formed as a single layer or, alternatively, as multiple layers. In certain embodiments, the jacket 120 may be formed from one or more layers of foamed material. As desired, the jacket 120 can include flame retardant and/or smoke suppressant materials. Additionally, the jacket 120 may include a wide variety of suitable shapes and/or dimensions. For example, the jacket 120 may be formed to result in a round cable or a cable having an approximately circular cross-section; however, the jacket 120 and internal components may be formed to result in other desired shapes, such as an elliptical, oval, or rectangular shape. The jacket 120 may also have a wide variety of dimensions, such as any suitable or desirable outer diameter and/or any suitable or desirable wall thickness. In various embodiments, the jacket 120 can be characterized as an outer jacket, an outer sheath, a casing, a circumferential cover, or a shell.

An opening enclosed by the jacket 120 may be referred to as a cable core, and the twisted pairs 105A-D, the separator 110, and other cable components (e.g., one or more shield layers, etc.) may be disposed within the cable core. Although a single cable core is illustrated in FIG. 1, a cable 100 may be formed to include multiple cable cores. In certain embodiments, a cable core may be filled with a gas such as air (as illustrated) or alternatively a gel, solid, powder, moisture absorbing material, water-swellable substance, dry filling compound, or foam material, for example in interstitial spaces between the twisted pairs 105A-D. In addition to the separator 110 and any shield layers, other elements can be added to the cable core as desired, for example one or more optical fibers, additional electrical conductors, additional twisted pairs, water absorbing materials, and/or strength members, depending upon application goals.

In certain embodiments, one or more shield layers may be incorporated into the cable 100. For example, as shown in FIG. 1, an overall shield 115 or an external shield may be disposed between the jacket 120 and the twisted pairs 105A-D. In other words, the overall shield 115 may be wrapped around and/or encompass the collective group of twisted pairs 105A-D and the separator 110. As shown, the overall shield 115 may be positioned between the twisted pairs 105A-D and the outer jacket 120. In other embodiments, the overall shield 115 may be embedded into the outer jacket 120, incorporated into the outer jacket 120, or even positioned outside of the outer jacket 120. In other example embodiments, individual shields may be provided for each of the twisted pairs 105A-D. In yet other embodiments, shield layers may be provided for any desired groupings of twisted pairs. As desired, multiple shield layers may be provided, for example, individual shields and an overall shield. Each utilized shield layer may incorporate suitable shielding material, such as electrically conductive material, semi-conductive material, and/or dielectric shielding material in order to provide electrical shielding for one or more cable components. Further, in certain embodiments, the cable 120 may include a separate armor layer (e.g., a corrugated armor, etc.) for providing mechanical protection.

Various embodiments of the overall shield 115 illustrated in FIG. 1 are generally described herein; however, it will be appreciated that other shield layers (e.g., individual shield layers, etc.) may have similar constructions. In certain embodiments, a shield 115 may be formed from a single segment or portion that extends along a longitudinal length of the cable 100. In other embodiments, a shield 115 may be formed from a plurality of discrete segments or portions positioned adjacent to one another along a longitudinal length of the cable 100. In the event that discrete segments or portions are utilized, in certain embodiments, gaps or spaces may exist between adjacent segments or portions. In other embodiments, certain segments may overlap one another. For example, an overlap may be formed between segments positioned adjacent to one another along a longitudinal length of the cable.

As desired, a shield 115 (or a shield segment) may be formed with a wide variety of suitable constructions and/or utilizing a wide variety of suitable techniques. In certain embodiments, a foil shield or braided shield may be utilized. In other embodiments, a shield 115 may be formed from a combination of dielectric material and shielding material. For example, a shield may be formed from a suitable tape structure that includes one or more dielectric layers and one or more layers of shielding material. As desired, a shield 115 may be formed as a relatively continuous shield (e.g., a shield with a relatively continuous layer of electrically conductive material, shielding material, etc.) or as a discontinuous shield having a plurality of isolated patches of shielding material. For a discontinuous shield, a plurality of patches of shielding material may be incorporated into the shield 115, and gaps or spaces may be present between adjacent patches in a longitudinal direction. A wide variety of different patch patterns may be formed as desired in various embodiments, and a patch pattern may include a period or definite step. In other embodiments, patches may be formed in a random or pseudo-random manner. Additionally, individual patches may be separated from one another so that each patch is electrically isolated from the other patches. That is, the respective physical separations between the patches may impede the flow of electricity between adjacent patches. In certain embodiments, the physical separation of other patches may be formed by gaps or spaces, such as gaps of dielectric material or air gaps.

A shield 115 may be formed from a wide variety of suitable materials and/or combinations of materials. For example, a shield 115 may include any number of suitable dielectric and/or shielding materials. A wide variety of suitable dielectric materials may be utilized to form one or more dielectric layers or portions of a shield 115 including, but not limited to, paper, various plastics, one or more polymeric materials, one or more polyolefins (e.g., polyethylene, polypropylene, etc.), one or more fluoropolymers (e.g., fluorinated ethylene propylene ("FEP"), melt processable fluoropolymers, MFA, PFA, polytetrafluoroethylene, ethylene tetrafluoroethylene ("ETFE"), ethylene chlorotrifluoroethylene ("ECTFE"), etc.), one or more polyesters, polyimide, polyvinyl chloride ("PVC"), one or more flame retardant olefins (e.g., flame retardant polyethylene ("FRPE"), flame retardant polypropylene ("FRPP"), a low smoke zero halogen ("LSZH") material, etc.), polyurethane, neoprene, cholorosulphonated polyethylene, flame retardant PVC, low temperature oil resistant PVC, flame retardant polyurethane, flexible PVC, or any other suitable material or combination of materials. As desired, one or more foamed materials may be utilized. Indeed, a dielectric layer may be filled, unfilled, foamed, un-foamed, homogeneous, or inhomogeneous and may or may not include one or more additives (e.g., flame retardant and/or smoke suppressant materials). Additionally, a dielectric layer may be formed with a wide variety of suitable thicknesses.

Additionally, each shielding layer or shielding portion of a shield 115 may be formed from a wide variety of suitable shielding materials and/or with a wide variety of suitable dimensions. As set forth above, a shielding layer may be formed as a relatively continuous layer or as a discontinuous layer having a plurality of isolated patches of shielding material. In certain embodiments, one or more electrically conductive materials may be utilized as shielding material including, but not limited to, metallic material (e.g., silver, copper, nickel, steel, iron, annealed copper, gold, aluminum, etc.), metallic alloys, conductive composite materials, etc. Indeed, suitable electrically conductive materials may include any material having an electrical resistivity of less than approximately $1\times10_{-7}$ ohm meters at approximately 20° C. In certain embodiments, an electrically conductive material may have an electrical resistivity of less than approximately $3\times10^{-8}$ ohm meters at approximately 20° C. In other embodiments, one or more semi-conductive materials may be utilized including, but not limited to, silicon, germanium, other elemental semiconductors, compound semiconductors, materials embedded with conductive particles, etc. In yet other embodiments, one or more dielectric shielding materials may be utilized including, but not limited to, barium ferrite, etc.

Additionally, a shielding layer and/or associated shielding material may be incorporated into a shield 115 utilizing a wide variety of suitable techniques and/or configurations. For example, shielding material may be formed on a base layer or a dielectric layer. In certain embodiments, a separate base dielectric layer and shielding layer may be bonded, adhered, or otherwise joined (e.g., glued, etc.) together to form a shield 115. In other embodiments, shielding material may be formed on a dielectric layer via any number of suitable techniques, such as the application of metallic ink or paint, liquid metal deposition, vapor deposition, welding, heat fusion, adherence of patches to the dielectric, or etching of patches from a metallic sheet. In certain embodiments, the shielding material can be over-coated with a dielectric layer or electrically insulating film, such as a polyester coating. In other embodiments, shielding material may be embedded into a base layer or dielectric layer. In yet other embodiments, a shield 115 may be formed (e.g., extruded, etc.) from a shielding material.

The components of a shield 115 (or segment of a shield) may include a wide variety of suitable dimensions, for example, any suitable lengths in the longitudinal direction, widths (i.e., a distance of the shield that will be wrapped around one or more twisted pairs 105A-D) and/or any suitable thicknesses. For example, shielding material may have any desired thickness, such as a thickness of about 0.5 mils (about 13 microns) or greater. In many applications, signal performance may benefit from a thickness that is greater than about 2 mils, for example in a range of about 2.0 to about 2.5 mils, about 2.0 to about 2.25 mils, about 2.25 to about 2.5 mils, about 2.5 to about 3.0 mils, or about 2.0 to about 3.0 mils.

Additionally, a wide variety of segment and/or patch lengths (e.g., lengths along a longitudinal direction of the cable 100) may be utilized. As desired, the dimensions of the segments and/or patches can be selected to provide electromagnetic shielding over a specific band of electromagnetic frequencies or above or below a designated frequency threshold. In certain embodiments, each patch of shielding material may have a length of about 0.05, 0.1, 0.2, 0.25, 0.3, 0.4, 0.5, 0.6, 0.7, 0.75, 0.8, 0.9, 1.0, 1.5, 2.0, 2.5, 3.0, 3.5, 4.0, 4.5, or 5.0 meters, a length included in a range between any two of the above values, or a length included in a range bounded on either a minimum or maximum end by one of the above values. Additionally, a wide variety of suitable gap distances or isolation gaps may be provided between adjacent patches. For example, the isolation spaces can have a length of about 0.5, 1.0, 1.5, 2.0, 2.5, 3.0, 3.5, 4, 5, 6, 7, 8, 9, or 10 mm, a length included in a range between any two of the above values, or a length included in a range bounded on either a minimum or maximum end by one of the above values.

In certain embodiments, a shielding layer may include shielding material or patches of shielding material that extend substantially across a width dimension of an underlying dielectric layer. In other embodiments, shielding material may be formed with a width that is different than the width of an underlying base layer or portion of the base layer. In yet other embodiments, a plurality of discontinuous patches of shielding material may be formed across or within a widthwise dimension, and widthwise gaps may be present between each of the plurality of patches. Indeed, any section or patch of shielding material may have any suitable width and a wide variety of different configurations of shielding material may be formed in a widthwise dimension. Additionally, patches of shielding material may have a wide variety of different shapes and/or orientations. For example, the patches may have a rectangular, trapezoidal, approximately triangular, or parallelogram shape. In certain embodiments, patches may be formed to be approximately perpendicular (e.g., square or rectangular segments and/or patches) to the longitudinal axis of twisted pairs 105A-D incorporated into a cable. In other embodiments, the patches may have a spiral direction that is opposite the twist direction of one or more pairs. That is, if the twisted pair(s) 105A-D are twisted in a clockwise direction, then the segments and/or patches may spiral in a counterclockwise direction. If the twisted pair(s) are twisted in a counterclockwise direction, then the conductive patches may spiral in a clockwise direction. In certain embodiments, the opposite directions may provide an enhanced level of shielding performance. In other embodiments, patches may have a spiral direction that is the same as the twist direction of one or more pairs.

With continued reference to FIG. 1, a separator 110 or filler may be incorporated into the cable 100 and positioned between two or more of the twisted pairs 105A-D. In certain embodiments, the separator 110 may be configured to orient and or position one or more of the twisted pairs 105A-D. The orientation of the twisted pairs 105A-D relative to one another may provide beneficial signal performance. The separator 110 may include a plurality of bristles, filaments, or other extensions 125A-H that radially project from a central spine 130 or central portion. As explained in greater detail below, the central spine 130 and the bristles 125A-H may be formed from a wide variety of suitable materials, may have a wide variety of suitable dimensions, and may be arranged in a wide variety of suitable configurations.

According to an aspect of the disclosure, a first portion of the bristles, such as illustrated bristles 125A, 125C, 125E, 125G, may respectively extend from the spine 130 between one or more sets of adjacent twisted pairs, thereby providing separation between the adjacent twisted pairs. For example, a first bristle 125A may extend between a first set of adjacent twisted pairs 105A, 105D, a second bristle 125C may extend between a second set of adjacent twisted pairs 105A. 105B, a third bristle 125E may extend between a third set of adjacent twisted pairs 105B, 105C, and a fourth bristle 125D may extend between a fourth set of adjacent twisted pairs 105C, 105D. As desired in various embodiments, any suitable number of bristles may respectively extend between each set of adjacent twisted pairs along a longitudinal length of the cable 100. Additionally, the bristles that extend between adjacent sets of twisted pairs may provide separation between the twisted pairs 105A-D and/or may assist in maintaining the positions of the twisted pairs 105A-D, thereby limiting or reducing cross-talk and enhancing the electrical performance of the cable 100.

Additionally, a second portion of the bristles, such as illustrated bristles 125B, 125D, 125F, 125H, may be respectively compressed by one or more of the twisted pairs 105A-D back towards the spine 130. For example, a fifth bristle 125B may be compressed by a first twisted pair 105A, a sixth bristle 125D may be compressed by a second twisted pair 105B, a seventh bristle 125F may be compressed by a third twisted pair 105C, and an eighth bristle 125H may be compressed by a fourth twisted pair 105D. Any number of bristles may be compressed along a longitudinal length of the cable 100. The compressed bristles may provide central core separation for the twisted pairs 105A-D. In other words, the compressed bristles may increase the separation between the twisted pairs 105A-D and the spine 130. Additionally, the compressed bristles may increase the separation between various sets of twisted pairs, such as twisted pairs that are positioned diagonally across from one another (e.g., twisted pairs 105A and 105C, twisted pairs 105B and 105D) and, in some cases, adjacent sets of twisted pairs. As desired in certain embodiments, the compressed bristles may exhibit a spring action that enhances the central core and/or twisted pairs separation.

The central spine 130 (or spine 130) may be formed with a wide variety of suitable dimensions and/or constructions. For example, the spine 130 may be formed with any suitable cross-sectional shape. As shown in FIG. 1, the spine 130 may have a circular or rod-like cross-sectional shape. In other embodiments, the spine 130 may be formed with an elliptical, rectangular, approximately rectangular (e.g., rectangular with rounded corners, etc.) square, approximately square, triangular, hexagonal, octagonal, or any other suitable cross-sectional shape. For example, the spine 130 may be formed with any of the cross-sectional shapes discussed below for example bristles with reference to FIGS. 4A-4G. Additionally, the spine 130 may be formed with a wide variety of suitable diameters and/or cross-sectional areas. For example, the spine 130 may have a diameter of approximately 0.01, 0.02, 0.03, 0.04, 0.05, 0.06, 0.07, 0.08, 0.09, 0.10, 0.12, 0.14, 0.15, 0.16, 0.18, or 0.20 inches, a diameter included in a range between any two of the above values (e.g., a diameter between approximately 0.01 and approximately 0.10 inches, etc.), or a diameter included in a range bounded on either a minimum or maximum end by one of the above values. As another example, the spine 130 may have a cross-sectional area of approximately $7.85\times10^{-5}$, $3.14\times10^{-4}$, $1.256\times10^{-3}$, $1.962\times10^{-3}$, $2.826\times10^{-3}$, $5.02\times10^{-3}$, $7.85\times10^{3}$, $1.76\times10^{-2}$, or $3.14\times10^{-2}$ square inches, a cross-sectional area included in a range between any two of the above values, or a cross-sectional area included in a range bounded on either a minimum or maximum end by one of the above values.

The spine 130 may also be formed with a wide variety of suitable lengths. In certain embodiments, the spine 130 may be formed from a single segment or portion that extends along a longitudinal length of the cable 100. In other embodiments, the spine 130 may be formed from a plurality of discrete segments or portions positioned adjacent to one another along a longitudinal length of the cable 100, such as a plurality of segments that are arranged end to end. In the event that discrete segments or portions are utilized, in certain embodiments, gaps or spaces may exist between adjacent segments or portions. In other embodiments, certain segments may overlap one another. For example, an overlap may be formed between segments positioned adjacent to one another along a longitudinal length of the cable. Regardless of whether a spine 130 is formed from one or a plurality of segments, as desired in various embodiments, one or more dimensions of the spine 130 may be varied along a longitudinal direction. For example, the spine 130 may include various portions with different diameters, cross-sectional shapes, and/or other dimensions. Dimensional variations may be arranged in accordance with any desirable pattern or, alternatively, in a random or pseudo-random manner.

The spine 130 may also be formed from a wide variety of suitable materials and/or combinations of materials including, but not limited to, dielectric materials (e.g., polymeric materials, etc.), conductive materials, semi-conductive materials, etc. For example, the spine 130 may be formed from paper, metals, alloys, various plastics, one or more polymeric materials, one or more polyolefins (e.g., polyethylene, polypropylene, etc.), one or more fluoropolymers (e.g., fluorinated ethylene propylene ("FEP"), melt processable fluoropolymers, MFA, PFA, ethylene tetrafluoroethylene ("ETFE"), ethylene chlorotrifluoroethylene ("ECTFE"), etc.), one or more polyesters, polyvinyl chloride ("PVC"), one or more flame retardant olefins (e.g., flame retardant polyethylene ("FRPE"), flame retardant polypropylene ("FRPP"), a low smoke zero halogen ("LSZH") material, etc.), polyurethane, neoprene, cholorosulphonated polyethylene, flame retardant PVC, low temperature oil resistant PVC, flame retardant polyurethane, flexible PVC, one or more semi-conductive materials (e.g., materials that incorporate carbon, etc.), one or more dielectric shielding materials (e.g., barium ferrite, etc.) or any other suitable material or combination of materials. In certain embodiments, the spine 130 may have a relatively flexible body. As desired, the spine 130 may be filled, unfilled, foamed, un-foamed, homogeneous, or inhomogeneous and may or may not include additives (e.g., flame retardant materials, smoke suppressant materials, strength members, water swallable materials, water blocking materials, etc.). In certain embodiments, the spine 130 may include one or more longitudinal channels or cavities. For example, one or more longitudinal channels may facilitate temperature normalization and/or cooling within the cable. As another example, one or more channels and/or cavities may be provided and other suitable cable components may be positioned with the channels and/or cavities including, but not limited to, transmission media (e.g., one or more optical fibers), flame retardant material, smoke suppressant material, etc.

In certain embodiments, the spine 130 may be formed without incorporating shielding material. For example, the separator 130 may be formed from suitable dielectric materials. In other embodiments, electromagnetic shielding material may be incorporated into the spine 130. A wide variety of different types of materials may be utilized to provide shielding, such as electrically conductive material, semi-conductive material, and/or dielectric shielding material. A few examples of suitable materials are described in greater detail above with reference to the overall shield 115. In certain embodiments, shielding material may be formed on one or more surfaces of the spine 130. For example, shielding material may be formed on an external surface of the spine 130 and/or within one or more channels. In other embodiments, shielding material may be embedded within the body of the spine 130. In yet other embodiments, a spine 130 may be formed from one or more suitable shielding materials.

For a spine 130 formed from a plurality of discrete segments, the various portions or segments of the spine 130 may include a wide variety of different lengths and/or sizes. In certain embodiments, spine portions may have a common length. In other embodiments, portions of the spine 130 may have varying lengths. These varying lengths may follow an established pattern or, alternatively, may be incorporated into the cable at random. Additionally, in certain embodiments, each segment or portion of the spine 130 may be formed from similar materials. In other embodiments, a spine 130 may make use of alternating materials in adjacent portions (whether or not a gap is formed between adjacent portions). For example, a first portion or segment of the spine 130 may be formed from a first set of one or more materials, and a second portion or segment of the spine 130 may be formed from a second set of one or more materials. As one example, a relatively flexible material may be utilized in every other portion of a spine 130. As another example, relatively expensive flame retardant material may be selectively incorporated into desired portions of a spine 130. In this regard, material costs may be reduced while still providing adequate flame retardant qualities.

According to an aspect of the disclosure, a plurality of bristles 125A-H may extend or project from the spine 130. As set forth above, a bristle or extension (generally referred to as bristle 125) may include any suitable projection that radially extends from a spine 130 and that may be compressed, bent, or folded in an inward motion in the event that it comes into contact with a twisted pair and is not able to project between two adjacent twisted pairs. Additionally, a bristle 125 may provide separation between a set of adjacent twisted pairs when it extends between the two twisted pairs rather than being compressed. In various embodiments, a bristle may be alternatively referred to as a filament, fiber, extension, extending portion, or a projection.

A bristle 125 may be formed with a wide variety of suitable dimensions, such as a wide variety of suitable cross-sectional shapes, cross-sectional areas, and/or lengths (e.g., a length that the bristle extends from a spine). For example, a bristle 125 may be formed with a circular, elliptical, square, approximately square (e.g., square with rounded corners, etc.), rectangular, approximately rectangular, triangular, hexagonal, octagonal, or any other suitable cross-sectional shape. A few example cross-sectional shapes that may be utilized for a bristle 125 are described in greater detail below with reference to FIGS. 4A-4G.

Additionally, a bristle 125 may be formed with a wide variety of suitable diameters, thicknesses, and/or cross-sectional areas. For example, a bristle 125 may have a diameter of approximately 0.003, 0.005, 0.007, 0.01, 0.015, 0.02, 0.025, 0.03, 0.04, 0.05, 0.06, 0.07, 0.08, 0.09, or 0.1 inches, a diameter included in a range between any two of the above values (e.g., a diameter between approximately 0.003 and approximately 0.08 inches, etc.), or a diameter included in a range bounded on either a minimum or maximum end by one of the above values. As another example, a bristle 125 may have a cross-sectional area of approximately $7.07\times10^{-6}$, $7.85\times10^{-5}$, $3.14\times10^{-4}$, $7.06\times10^{-4}$, $1.26\times10^{-3}$, $2.82\times10^{-3}$, $5.03\times10^{-3}$, or $7.85\times10^{-3}$ square inches, a cross-sectional area included in a range between any two of the above values, or a cross-sectional area included in a range bounded on either a minimum or maximum end by one of the above values. In certain embodiments, a diameter, thickness, or cross-sectional area of a diameter may correspond to an amount of separation distance provided by a bristle 125. For example, when a bristle 125 is positioned between or extends between two adjacent twisted pairs, the diameter, thickness, or cross-sectional area of the bristle 125 may define or correlate to a minimum separation distance between the adjacent pairs. As another example, if a bristle 125 extends beyond and is wrapped around an outer periphery of the twisted pairs 105A-D, then the diameter, thickness, or cross-sectional area of the bristle 125 may define or correlate to a minimum separation distance between the twisted pairs 105A-D and an adjacent wrap layer (e.g., a shield layer 115, a jacket 120, etc.).

A bristle 125 may also be formed with a wide variety of suitable lengths. In other words, a bristle 125 may project or extend any suitable distance from the spine 130. In certain embodiments, a bristle 125 may have a length that is less than or approximately equal to the diameter of a twisted pair 105 (e.g., the combined diameters of the two conductors of a twisted pair 105). For example, a bristle 125 may have a length that is approximately 0.25, 0.3, 0.35, 0.4, 0.45, 0.5, 0.55, 0.6, 0.65, 0.7, 0.75, 0.8, 0.85, 0.9, or 1.0 times the diameter of a twisted pair 105, a length included in a range between any two of the above values, or a length included in a range bounded on either a minimum or maximum end by one of the above values. In other embodiments, a bristle 125 may have a length that permits the bristle 125 to extend beyond an outer periphery of the twisted pairs 105A-D (e.g., the space occupied by the twisted pairs 105A-D in a cable core). As desired, an extending portion of the bristle 125 may be curled or wrapped around the outer periphery of the twisted pairs 105A-D. In this regard, the bristle 125 may provide separation between the twisted pairs 105A-D and one or more other cable components, such as a shield layer 115 or an outer jacket 120. In various example embodiments, a bristle may have a length of approximately 0.03, 0.04, 0.05, 0.07, 0.08, 0.1, 0.2, 0.3, 0.4, 0.5, 0.6, 0.7, or 0.8 inches, a length included in a range between any two of the above values (e.g., a length between approximately 0.03 and approximately 0.7 inches, etc.), or a length included in a range bounded on either a minimum or maximum end by one of the above values.

Additionally, the lengths discussed above refer to a bristle 125 that extends in a single direction from the spine 130. In certain embodiments, a bristle 125 may extend through the spine 130 and in multiple directions from the spine 130 (e.g., in both a north and south direction, in both an east and west direction, etc.). In these embodiments, a bristle 125 may be formed with a length that accounts for both directions of extension and the diameter or cross-sectional area of the spine 130. Further, in certain embodiments, each bristle 125 may be formed with substantially similar dimensions (e.g., cross-sectional shape, cross-sectional area, length, etc.). In other embodiments, at least two bristles may be formed with different dimensions.

A bristle 125 may be formed from a wide variety of suitable materials and/or combinations of materials including, but not limited to, dielectric materials (e.g., polymeric materials, etc.), conductive materials, semi-conductive materials, etc. In certain embodiments, a bristle may be formed from materials that permit the bristle 125 to provide desirable separation when extending between adjacent twisted pairs while also being flexible enough to be compressed towards the spine when it does not extend between adjacent twisted pairs. For example, a bristle 125 may be formed from paper, metals, alloys, various plastics, one or more polymeric materials, one or more polyolefins (e.g., polyethylene, polypropylene, etc.), one or more fluoropolymers (e.g., fluorinated ethylene propylene ("FEP"), melt processable fluoropolymers, MFA, PFA, ethylene tetrafluoroethylene ("ETFE"), ethylene chlorotrifluoroethylene ("ECTFE"), etc.), one or more polyesters, polyvinyl chloride ("PVC"), one or more flame retardant olefins (e.g., flame retardant polyethylene ("FRPE"), flame retardant polypropylene ("FRPP"), a low smoke zero halogen ("LSZH") material, etc.), polyurethane, neoprene, cholorosulphonated polyethylene, flame retardant PVC, low temperature oil resistant PVC, flame retardant polyurethane, flexible PVC, one or more semi-conductive materials (e.g., materials that incorporate carbon, etc.), one or more dielectric shielding materials (e.g., barium ferrite, etc.) or any other suitable material or combination of materials. Additionally, in various embodiments, a bristle 125 may be formed with any number of suitable layers, such as one or a plurality of layers. As desired, a bristle 125 may be foamed, un-foamed, homogeneous, or inhomogeneous and may or may not include additives (e.g., flame retardant materials, smoke suppressant materials, shielding materials, water swallable materials, water blocking materials, etc.). A few example material and/or layer constructions that may be utilized for bristles 125 are discussed in greater detail below with reference FIGS. 5A-5E.

In certain embodiments, each of the bristles 125A-H may be formed with similar dimensions and/or material constructions. In other embodiments, at least two bristles may be formed with different dimensions (e.g., diameters, cross-sectional shapes, etc.) and/or material constructions. For example, a first portion of the bristles 125A-H may be formed from flame retardant materials while a second portion of the bristles 125A-H may be formed from other materials. As desired, bristles having different dimensions and/or material constructions may be arranged in accordance with any desirable pattern or, alternatively, in a random or pseudo-random manner.

According to an aspect of the disclosure, a portion of the bristles 125A-H may be compressed by one or more of the twisted pairs 105A-D back towards the spine 130. In other words, the bristles 125A-H may be formed as relatively flexible extensions and/or from relatively flexible material (s) that permit compression of the bristles. In certain embodiments, a bristle 125 may have a modulus of elasticity of approximately 30, 50, 100, 150, 200, 250, 300, 350, 400, 450, or 480 Kpsi, a modulus of elasticity incorporated into a range between any two of the above values (e.g., a modulus of elasticity between approximately 30 and approximately 480 Kpsi, etc.), or a modulus of elasticity incorporated into a range bounded on either a minimum or a maximum end by one of the above values. As desired, the bristles 125A-H may be formed from one or more material (s) that provide the bristles 125A-H with a spring force when compressed, thereby causing the bristles 125A-H to push back against the compressing twisted pairs 105A-D. The spring forces associated with compressed bristles 125A-H may assist in maintaining separation distance(s) between various twisted pairs 105A-D and/or between the twisted pairs 105A-D and the spine 130. In certain embodiments, a compressed bristle 125 may exhibit a spring force of approximately 0.125, 0.250, 0.375, 0.50, 0.625, 0.75, 0.875, 1.0, 1.125, or 1.25 pounds, a spring force incorporated into a range between any two of the above values (e.g., a spring force between approximately 0.125 and 1.125 pounds, etc.), or a spring force incorporated into a range bounded on either a minimum or a maximum end by one of the above values.

Any number of bristles 125A-H may extend from the spine 130 as desired in various embodiments. Additionally, various bristles 125A-H may extend from the spine in any suitable direction and/or combinations of directions. For example, along a longitudinally length of the spine, different bristles 125A-H may extend from the spine 130 in a plurality of different directions. In this regard, various bristles 125A-H may extend between different sets of adjacent twisted pairs 105A-D and/or various bristles 125A-H may be compressed by various twisted pairs 105A-D.

Figure 2A:
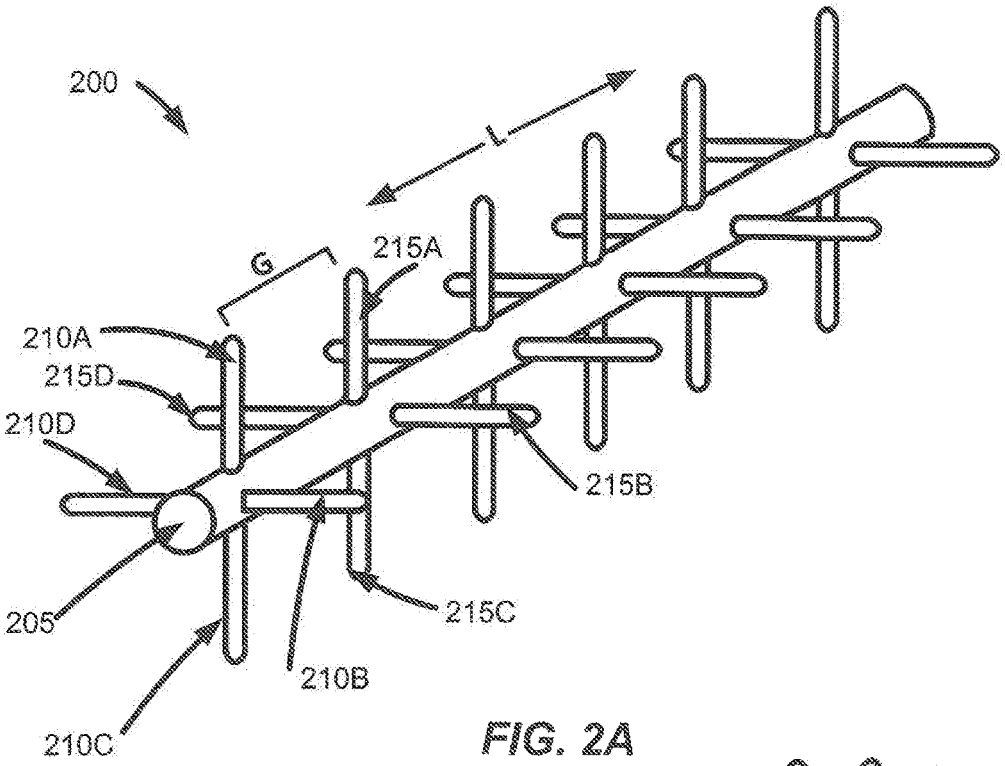
FIGS. 2A-2B are perspective views of example separators that include a plurality of bristles or extensions projecting from a spine, according to illustrative embodiments of the disclosure.

A wide variety of configurations and/or techniques may be utilized to vary the direction of extension for bristles. In certain embodiments, bristles may be formed to project in a plurality of different directions at given points along the longitudinal length of the spine 130. An example separator having a plurality of respective bristles extending from a plurality of longitudinally spaced locations is illustrated and described in greater detail below with reference to FIG. 2A. As desired, any number of bristles 125A-H may extend from a given cross-sectional point or location along the longitudinal length of the spine 130, for example, 2, 3, 4, 5, 6, 7, 8, or a greater number of bristles. Additionally, the bristles at a given location may extend in any suitable combination of directions. For example, as shown in FIG. 2A, four bristles may extend in approximately the four cardinal directions. In other embodiments, bristles may extend at a wide variety of angles relative to any of the cardinal directions. In certain embodiments, the number of bristles and/or directions of extension may be the same at a plurality of different cross-sectional locations. In other embodiments, at least two cross-sectional locations along the longitudinally length may include a different number of bristles and/or different directions of extension. Additionally, any suitable longitudinal gap or spacing may be present between adjacent sets of bristles that extend from the spine 130. In certain embodiments, the gaps may be formed in accordance with any desired pattern. In other embodiments, the gaps may be formed in a random or pseudo-random manner.

In other embodiments, bristles 125A-H may extend from the spine 130 in one or more spiraling, twisting, corkscrew, helical, or other suitable patterns along the longitudinal length. A pattern may be formed with any suitable number, rows, and/or other suitable configuration of bristles 125A-H. Additionally, a pattern may be formed with any desired period or lay. For example, a spiral pattern may wrap or spiral around the spine 130 with any suitable period or lay length. Examples of suitable periods or lay lengths include, but are not limited to, 0.1, 0.2, 0.4, 0.5, 0.6, 0.8, 1.0, 1.5, 2.0, 5.0, 8.0, 10.0, 12.0, 15.0, 18.0, 20.0, 25.0, 30.0, 35.0, 40.0, 45.0 or 50.0 inches (per 360 degrees of spiral twist), a length included in a range between any two of the above values (e.g., a length between approximately 0.1 and approximately 50.0 inches, etc.), or a length included in a range bounded on either a minimum or maximum end by one of the above values. Additionally, an example separator having a plurality of bristles incorporated into a spiral pattern is illustrated and described in greater detail below with reference to FIG. 2B.

In yet other embodiments, a separator 110 may be longitudinally twisted such that bristles 125A-H extend from the separator 110 in a plurality of directions along the longitudinal length of the separator 110. For example, a separator 110 may be formed with bristles extending in a finite number of directions (e.g., a single direction, two directions, etc.) and, when the spine 130 of the separator 110 is twisted, the bristles 125A-H may be arranged in a spiral pattern. In other words, as a result of the twisting, bristles 125A-H may project from the spine 130 in a plurality of various directions relative to their pre-twisted positions. A few examples of separators that may be longitudinally twisted are described in greater detail below with reference to FIGS. 3C and 3D.

A wide variety of suitable methods and/or techniques may be utilized to twist the separator 110 as desired in various embodiments. In certain embodiments, the separator 110 may be fed from one or more suitable sources (e.g., reels, spools, etc.) and connected downstream to one or more suitable twisting devices and/or machines that impart a twist on the separator 110 while back tension is supplied by the source(s) and/or any number of intermediary devices. The separator 110 may be twisted in a suitable direction "T", such as a clockwise or a counter-clockwise direction, as desired in various embodiments. Additionally, the separator 110 may be longitudinally twisted with any desired twist rate and/or twist lay. For example, the separator 110 may be longitudinally twisted to have any of the example twist lays set forth above with respect to spiral patterns. In various embodiments, the separator 110 may be twisted at a rate of approximately 1, 5, 10, 15, 20, 25, 30, 35, 40, 45, 50, 55, 60, 65, 70, 75, 80, 85, or 90 degrees per inch (or other suitable distance), a rate incorporated into a range between any two of the above values, or a rate incorporated into a range bounded on either a minimum or maximum end by one of the above values. In certain embodiments, the twist rate and/or twist lay may be based at least in part upon the number of bristles extending from the spine 130 at various cross-sectional locations. In other words, the twist rate and/or lay may be determined such that various bristles extend from the spine 130 in desired directions or at desired angles. In other embodiments, a separator 110 may be positioned between a plurality of twisted pairs 105A-D without being twisted.

Other techniques may be utilized as desired to vary the direction of extension for bristles 125A-H. As desired, any suitable combination of techniques may be utilized to vary the direction of extension. Indeed, a wide variety of suitable bristle arrangements may be utilized in conjunction with a spine 130 in order to form a separator 110. Additionally, bristles 125A-H may be positioned with any suitable density relative to a given surface area of the spine 130. For example, bristles may be positioned or formed with a density of approximately 10, 20, 30, 40, 50, 60, 80, 100, 125, 150, 175, 200, 250, 300, 350, 400, 450, 500, 550, 600, or 600 per square inch, a density included in a range between any two of the above values, or a density included in a range bounded on either a minimum or maximum end by one of the above values (e.g., a density of up to 650 bristles per square inch, etc.). In certain embodiments, a bristle density may be relative constant along an entire surface area of the spine 130. In other embodiments, the bristle density may vary in two or more sections or areas within the surface area of the spine 130. For example, bristles may be formed with a given density in areas associated with a spiral pattern while other areas of the spine 130 do not include any bristles. Additionally, given various bristle densities, any number of bristles (e.g., a clump of bristles, etc.) may extend between two adjacent twisted pairs or alternatively be compressed by one or more twisted pairs 105A-D at a given location or from a given area on the surface of the spine 130.

In certain embodiments, a separator 110 with bristles 125A-H extending from a central spine 130 may resemble a spout brush, bore brush, or similar structure. Additionally, as a result of incorporating a separator 110 with a plurality of bristles 125A-H extending from a spine 130 into a cable 100, desired spacing or separation may be provided between adjacent twisted pairs in order to reduce crosstalk. However, the resulting separator 110 may be formed with less overall material than conventional separators, thereby reducing the overall cost of the cable 100 relative to conventional cables.

For example, a central spine 130 may be formed with a relatively small cross-section because compressed bristles may provide adequate separation between twisted pairs that are diagonally positioned relative to one another (e.g., pairs 105A and 105C, pairs 105B and 105D). As another example, bristles 125A-H may be longitudinally positioned along the spine 130 in a spaced manner (e.g., at a plurality of spaced locations along a longitudinal length of the spine 130, in a spiral pattern, etc.), thereby utilizing less material than conventional separators that include longitudinally continuous fins or prongs. A bristle separator may also provide enhanced flexibility relative to conventional separator structures.

In certain embodiments, a separator 110 may include or incorporate electromagnetic shielding material. Accordingly, the separator 110 may provide shielding for one or more of the twisted pairs 105A-D. For example, a shielding layer may be incorporated into the spine 130 (e.g., on one or more surfaces of the spine 130, sandwiched between two other layers of the spine 130, etc.). As another example, the spine 130 and/or any number of bristles 125A-H may be formed from shielding material(s). As yet another example, shielding material may be embedded into the spine 130 and/or any number of bristles 125A-H. A wide variety of different types of materials may be utilized to provide shielding, such as electrically conductive material, semi-conductive material, and/or dielectric shielding material. A few examples of suitable materials are described in greater detail above with reference to other shielding layers. Additionally, in certain embodiments, the separator 110 may include shielding material and/or one or more shielding layers that are continuous along the longitudinal length of the separator 110. In other embodiments, the separator 110 may include discontinuous or discrete sections or portions of shielding material, such as discrete patches of shielding material incorporated into the spine 130 or discrete (e.g., unconnected or spaced) bristles that include shielding material.

As desired in various embodiments, a wide variety of other materials may be incorporated into the cable 100. For example, as set forth above, a cable may include any number of conductors, twisted pairs, optical fibers, and/or other transmission media. As another example, one or more respective dielectric films or other suitable components may be positioned between the individual conductors of one or more of the twisted pairs. In certain embodiments, one or more tubes or other structures may be situated around various transmission media and/or groups of transmission media. Additionally, as desired, a cable may include a wide variety of strength members, swellable materials (e.g., aramid yarns, blown swellable fibers, etc.), flame retardants, flame suppressants or extinguishants, gels, and/or other materials. The cable 100 illustrated in FIG. 1 is provided by way of example only. Embodiments of the disclosure contemplate a wide variety of other cables and cable constructions. These other cables may include more or less components than the cable 100 illustrated in FIG. 1. Additionally, certain components may have different dimensions and/or materials than the components illustrated in FIG. 1.

Example Separator Structures

Figure 2B:
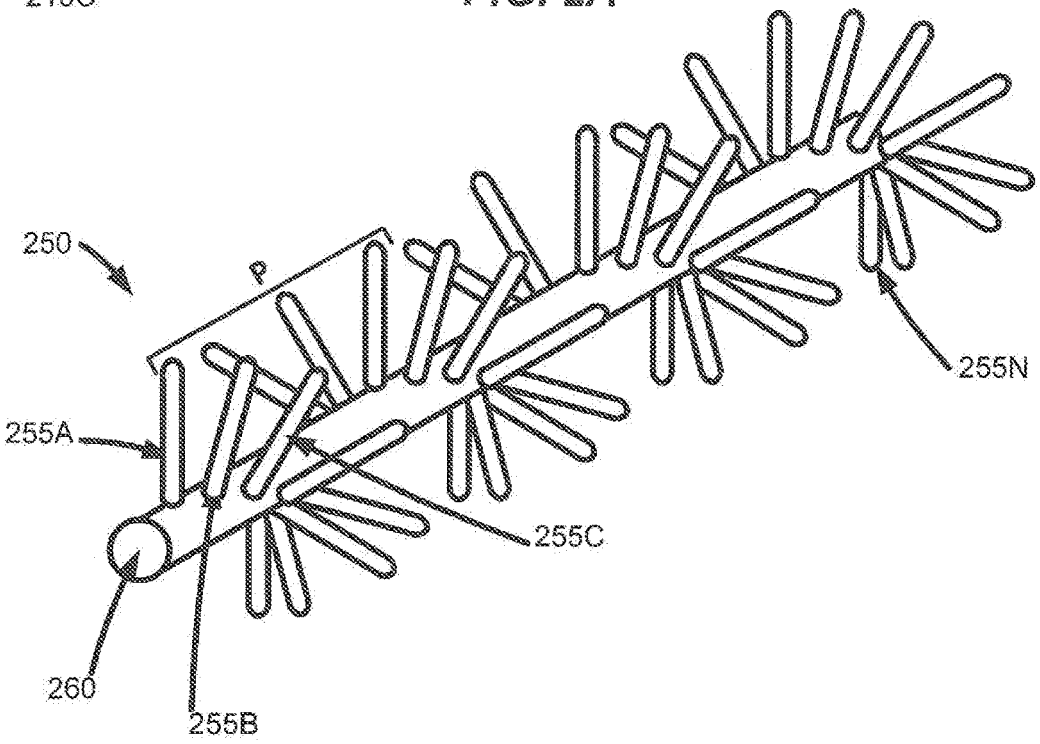

As set forth above, a wide variety of suitable separators may be utilized as desired in various embodiments of the disclosure. Additionally, various separators may include a wide variety of dimensions, bristle configurations, layers, and/or materials. FIGS. 2A-2B illustrate perspective views of a few example separators that may be utilized in accordance with various embodiments of the disclosure. FIGS. 3A-3D illustrate cross-sectional views of example separators in which bristles may extend from a spine in any number of suitable directions. Each of these figures is discussed in greater detail below.

Turning now to FIG. 2A, a perspective view of a first example separator 200 is illustrated. The separator 200 may include a spine 205, and a plurality of bristles may extend from the spine 205 along its longitudinal length "L". In certain embodiments, respective bristles may extend from the spine 205 at a plurality of longitudinally spaced locations along the length "L". For example, a first set of one or more bristles 210A-D may extend from a first longitudinally spaced location, a second set of one or more bristles 215A-D may extend from a second longitudinally spaced location, and so on along the longitudinal length "L". As set forth above, any number of bristles may extend from the spine 205 at each location. As shown in FIG. 2A, four respective bristles may extend from the spine 205 at each location in approximately the four cardinal directions. In other embodiments, other numbers of bristles (e.g., one, two, three, five, six, seven, eight, etc.) may extend from the spine 205 in any suitable direction or combination of directions. Additionally, in certain embodiments, an approximately equal number of bristles may extend in similar directions at each longitudinally spaced location. In other embodiments, a differing number of bristles and/or different directions of extension may be utilized at two or more different locations.

With continued reference to FIG. 2A, any suitable longitudinal gap "G" or spacing may be present between adjacent sets of bristles that extend from the spine 205 at spaced longitudinal locations. Examples of suitable gaps are described in greater detail above. In certain embodiments, the gaps may be formed in accordance with any desired pattern. In other embodiments, the gaps may be formed in a random or pseudo-random manner. Additionally, the bristles and/or the spine 205 may be formed with a wide variety of suitable dimensions and/or combinations of dimensions as desired in various embodiments and discussed in greater detail above.

FIG. 2B illustrates a perspective view of a second example separator 250 that includes a plurality of bristles 255A-N or extensions projecting from a spine 260. In certain embodiments, the bristles 255A-N may be formed to project from the spine 260 in one or more spiraling, twisting, corkscrew, helical, or other suitable patterns along the longitudinal length. A pattern may be formed with any suitable number, rows, and/or other suitable configuration of bristles. Additionally, a pattern may be formed with any desired period "P" or lay, such as any of the suitable periods discussed above. Further, the bristles 255A-N and/or the spine 260 may be formed with a wide variety of suitable dimensions and/or combinations of dimensions as desired in various embodiments and discussed in greater detail above.

Alternatively, the separator 250 of FIG. 2B may be viewed as a separator in which the spine 260 is longitudinally twisted in order to vary the direction of the extension of the bristles 255A-N. For example, the separator 250 may be initially formed with bristles 255A-N extending in one, two, or a few directions in a spaced manner along the longitudinal length of the spine 260. The spine 260 may then be longitudinally twisted such that the bristles 255A-N form one or more spiral patterns along the longitudinal length. As set forth above, the spine 260 may be twisted utilizing a wide variety of suitable methods and/or at a wide variety of suitable twist rates. For example, the spine 260 may be twisted at a desired rate in order to configure the bristles 255A-N in a spiral pattern having a desired period "P" or lay.

Figure 3A:
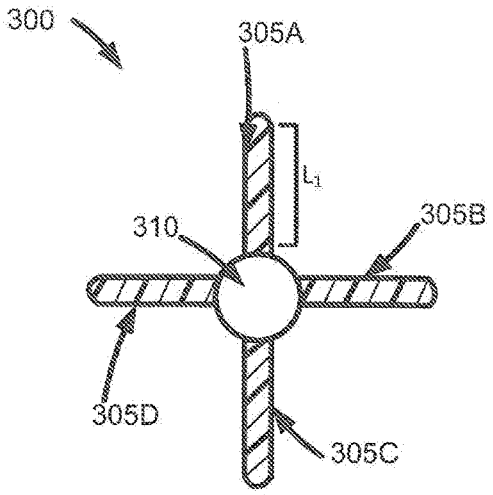
FIGS. 3A-3D cross-sectional views of example separator structures, according to illustrative embodiments of the disclosure.

As set forth above, a separator may be formed with any number of bristles extending from a spine in any number of suitable directions. Additionally, a separator and/or the various components of a separator may be formed from any suitable materials and/or combinations of materials. FIGS. 3A-3D illustrate cross-sectional views of a few example separator structures that may be utilized in various embodiments. Turning first to FIG. 3A, a cross-sectional view of a first example separator 300 is depicted. At the illustrated cross-sectional point, the separator 300 may include four bristles 305A-D extending from a spine 310 in approximately the four cardinal directions. As desired in certain embodiments, four bristles may extend in a similar manner at any number of other cross-sectional points along the longitudinal length of the separator 300. In other embodiments, a different number of bristles and/or different directions of bristle extension may be associated with one or more other cross-sectional points along the longitudinal length of the separator 300. For example, one or more spiral patterns may be formed. In yet other embodiments, the spine 310 may be longitudinally twisted in order to vary the direction of bristle extension. Indeed, a wide variety of suitable bristle configurations may be utilized.

Additionally, each bristle (generally referred to as bristle 305) may be formed with a wide variety of suitable dimensions, such as any suitable length "$L_1$", cross-sectional area, and/or diameter. Further, each bristle 305 may be formed from any suitable material or combination of materials. As shown, the bristles 305A-D may be formed from one or more suitable dielectric materials. In other embodiments, bristles 305A-D may be formed from semi-conductive or conductive material. Additionally, as desired in certain embodiments, at least two bristles may be formed from different materials. The spine 310 may also be formed from any suitable material(s) as described in greater detail above with reference to FIG. 1.

Figure 3B:
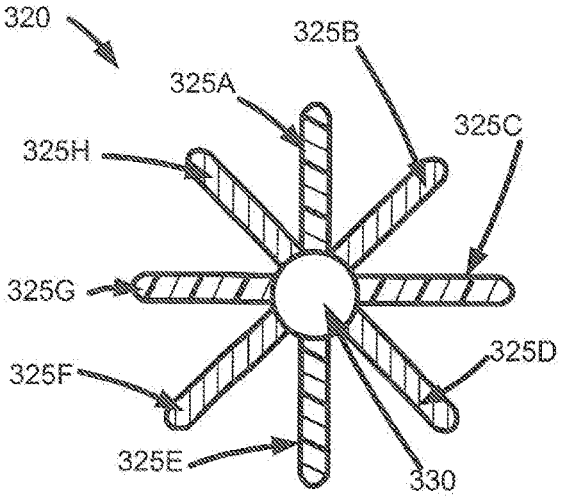

FIG. 3B illustrates a cross-sectional view of a second example separator 320. At the illustrated cross-sectional point, eight bristles 325A-H may extend from a spine 330. For example, a first set of four bristles 325A, 325C, 325E, 325G may extend approximately in the four cardinal directions, and a second set of four bristles 325B, 325D, 325F, 325H may extend in respective directions between the cardinal directions. As set forth above, bristles may extend in a similar manner at other cross-sectional locations or, alternatively, a number of bristles and/or direction(s) of bristle extension may be varied at different cross-sectional locations. In yet other embodiments, the spine 330 may be longitudinally twisted in order to vary the direction of bristle extension.

Additionally, each bristle may be formed with a wide variety of suitable dimensions and/or from a wide variety of suitable materials. In certain embodiments, each bristle may be formed from the same material(s). In other embodiments, at least two of the bristles may be formed from different materials. For example, as shown, the first set of bristles 325A, 325C, 325E, 325G may be formed from first material (s) while the second set of bristles 325B, 325D, 325F, 325H may be formed from second material(s). FIG. 3B illustrates a first set of bristles formed from one or more dielectric materials and a second set of bristles formed from one or more shielding materials. Certain embodiments with this bristle configuration may result in dielectric material being positioned between adjacent twisted pairs and shielding material being compressed towards the spine 330 by the twisted pairs. In other embodiments, the first set of bristles may be formed from one or more shielding materials while the second set of bristles is formed from one or more dielectric materials. In this regard, certain embodiments may include shielding material positioned between adjacent twisted pairs and dielectric material being compressed towards the spine (e.g., to increase a separation distance between diagonally positioned twisted pairs, etc.). A wide variety of other material combinations may be utilized as desired in various embodiments.

Figure 3C:
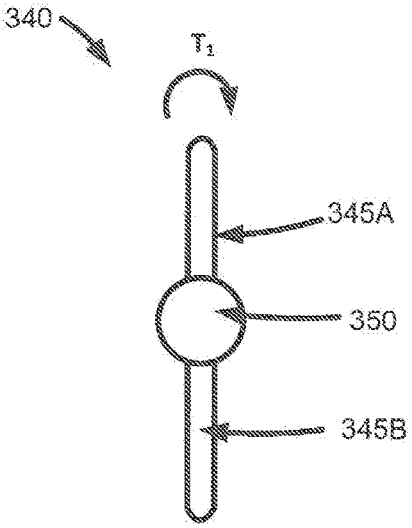

FIG. 3C illustrates a cross-sectional view of a third example separator 340. At the illustrated cross-sectional point, two bristles 345A, 345B may extend from a spine 350 in opposite directions. As desired, a repeating pattern of bristles extending in opposite directions may be formed at spaced locations along a longitudinal length of the separator 340. Additionally, the spine 350 may be longitudinally twisted in a desired direction "$T_1$", such as a clockwise direction. In this regard, bristles may be arranged in one or more spiral patterns with any suitable period that is based at least in part on the longitudinal twist rate. Further, as set forth above, the bristles may be formed with any suitable dimension(s) and or from any suitable material(s).

Figure 3D:
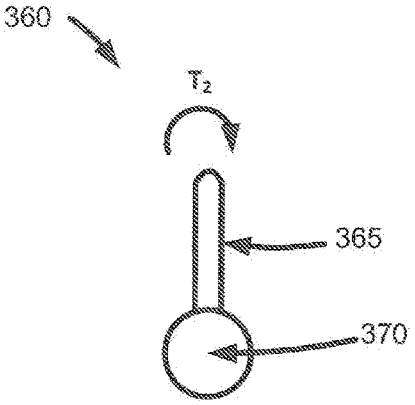

Similarly, FIG. 3D illustrates a cross-sectional view of a fourth example separator 360. At the illustrated cross-sectional point, one bristles 365 may extend from a spine 370 in a desired direction. In certain embodiments, a repeating pattern of bristles extending in a desired direction may be formed at spaced locations along a longitudinal length of the separator 360. Additionally, the spine 370 may be longitudinally twisted in a desired direction "$T_2$", such as a clockwise direction. In this regard, bristles may be arranged in a spiral pattern with any suitable period that is based at least in part on the longitudinal twist rate. Further, as set forth above, the bristles may be formed with any suitable dimension(s) and or from any suitable material(s).

A wide variety of other suitable separator configurations may be utilized as desired in various embodiments. These separators may include any number of bristles extending from a spine in a wide variety of suitable directions. Additionally, the various bristles and/or spines may be formed with a wide variety of suitable dimensions and/or from a wide variety of suitable materials. The separators 300, 320, 340, 360 illustrated in FIGS. 2A-3D are provided by way of non-limiting example only.

Example Bristles

As set forth above, bristles (e.g., such as bristle 125) may be formed with a wide variety of suitable dimensions, such as a wide variety of suitable lengths, diameters, and/or cross-sectional areas. Additionally, bristles may be formed from a wide variety of suitable materials and/or combinations of materials. FIGS. 4A-4G illustrate cross-sectional and side views of a few example bristles that may be utilized in accordance with various embodiments of the disclosure. FIGS. 5A-5E illustrate cross-sectional views of example material constructions that may be utilized in association with any suitable bristles. Each of these figures is discussed in greater detail below.

Figure 4A:
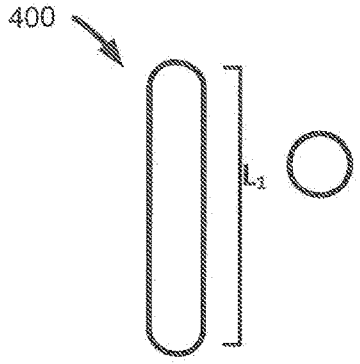
FIGS. 4A-4G are side and cross-sectional views of example bristles or extensions that may be incorporated into separators, according to illustrative embodiments of the disclosure.
Figure 4B:
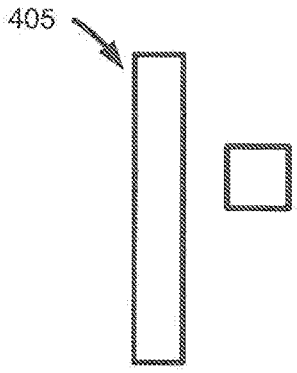
Figure 4C:
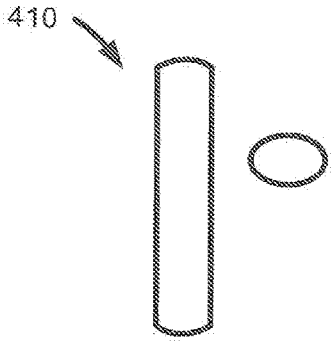
Figure 4D:
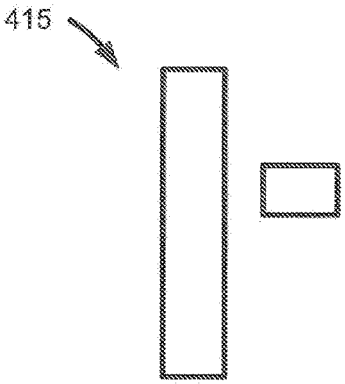
Figure 4E:
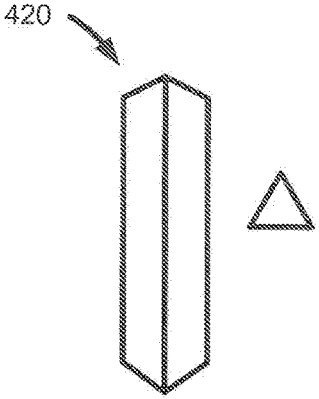
Figure 4F:
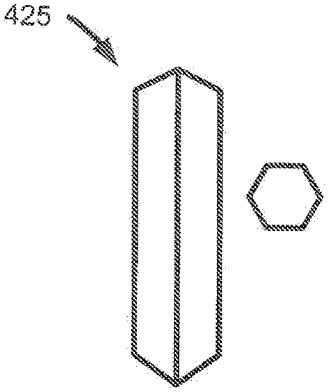
Figure 4G:
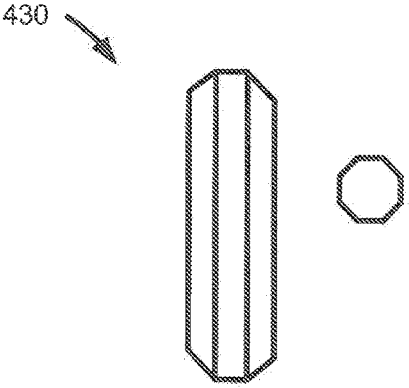

Turning first to FIG. 4A, a first example bristle 400 having an approximately circular cross-sectional shape is illustrated. The bristle 400 may be formed with any suitable length "$L_1$", diameter, and/or other dimensions. FIG. 4B illustrates a second example bristle 405 having a square cross-sectional shape. As desired, one or more corners may be rounded, curved, beveled or otherwise modified in order to result in a bristle having an approximately square cross-sectional shape. FIG. 4C illustrates a third example bristle 410 having an elliptical cross-sectional shape. As desired, the bristle 410 may be formed with any suitable ellipse axis length(s) and/or other suitable dimensions. FIG. 4D illustrates a fourth example bristle 415 having a rectangular cross-sectional shape. Much like the square bristle 405 of FIG. 4B, any number of corners may be modified in order to result in a bristle having an approximately rectangular cross-sectional shape. FIG. 4E illustrates a fifth example bristle 420 having a triangular cross-sectional shape; FIG. 4F illustrates a sixth example bristle 425 having a hexagonal cross-sectional shape; and FIG. 4G illustrates a seventh example bristle 430 having an octagonal cross-sectional shape. Any of the bristles may be formed with any suitable dimensions as desired, such as any suitable lengths and/or cross-sectional areas. Additionally, a wide variety of other suitable cross-sectional shapes may be utilized as desired in association with bristles, and those illustrated in FIGS. 4A-4G are provided by way of non-limiting example only.

Figure 5A:
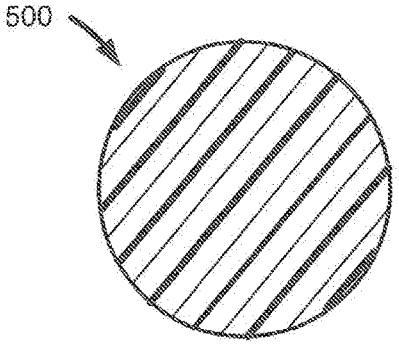
FIGS. 5A-5E are cross-sectional views of example bristle or extension material constructions, according to illustrative embodiments of the disclosure.
Figure 5B:
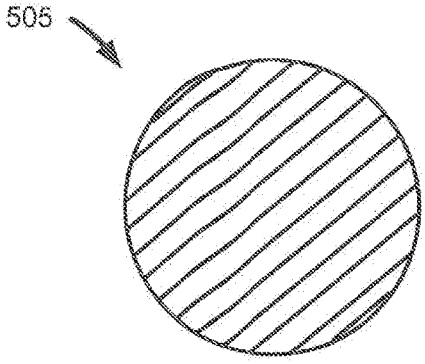
Figure 5C:
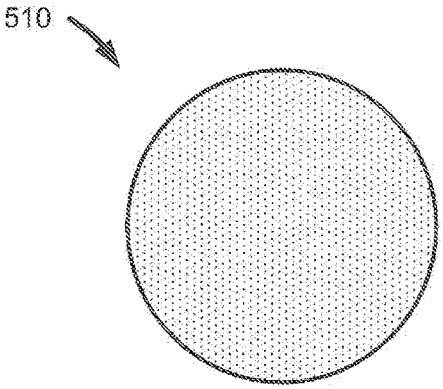
Figure 5D:
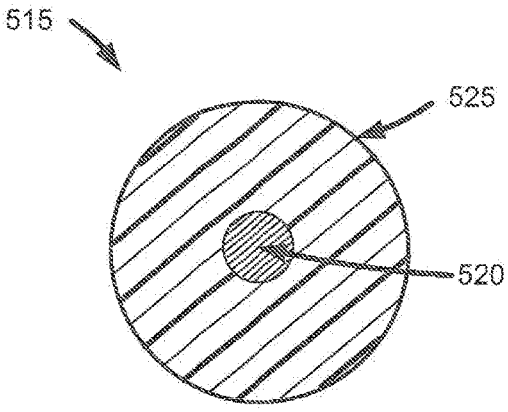
Figure 5E:
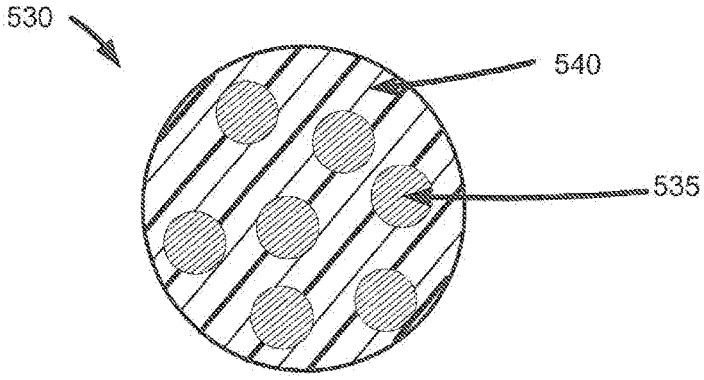

Additionally, as illustrated in FIGS. 5A-5E, bristles may be formed from a wide variety of suitable materials and/or combinations of materials. Although FIGS. 5A-5E depict example bristles having a circular cross-sectional shape, the illustrated material constructions are equally applicable to bristles having other cross-sectional shapes. FIG. 5A illustrates a first example bristle 500 that is formed from one or more dielectric materials. FIG. 5B illustrates a second example bristle 505 that is formed from one or more electrically conductive materials. FIG. 5C illustrates a third example bristle 510 that is formed from one or more semi-conductive materials. FIG. 5D illustrates a fourth example bristle 515 that may include a multi-layer construction. For example, the bristle 515 may include a first layer 520 of electrically conductive material and a second layer 525 of dielectric material formed around the first layer 520. As desired, the bristle 515 may be formed from any number of suitable layers, and a wide variety of layer arrangements may be utilized. For example, an electrically conductive layer may be formed on a dielectric layer. As another example, an electrically conductive layer may be sandwiched between two dielectric layers. A wide variety of other example constructions may be utilized in other embodiments. FIG. 5E illustrates a fifth example bristle 530 in which electrically conductive material 535 or other shielding material may be embedded in dielectric material 540. A wide variety of other material constructions may be utilized in association with bristles as desired in various embodiments, and those illustrated in FIGS. 5A-5E are provided by way of non-limiting example only.

Additionally, although the example cross-sectional shapes and material constructions illustrated in FIGS. 4A-5E are described as being associated with bristles, it will be appreciated that any of the shapes and/or material constructions are equally applicable to separator spines. For example, a spine may be formed with any suitable cross-sectional shape, such as a circular, elliptical, rectangular, square, triangular, hexagonal, or octagonal shape. A spine may also be formed from any suitable materials and/or combinations of materials. Further, a spine may be formed with any suitable number of layers and/or material configurations.

Example Method for Incorporating Separators into Cables

Figure 6:
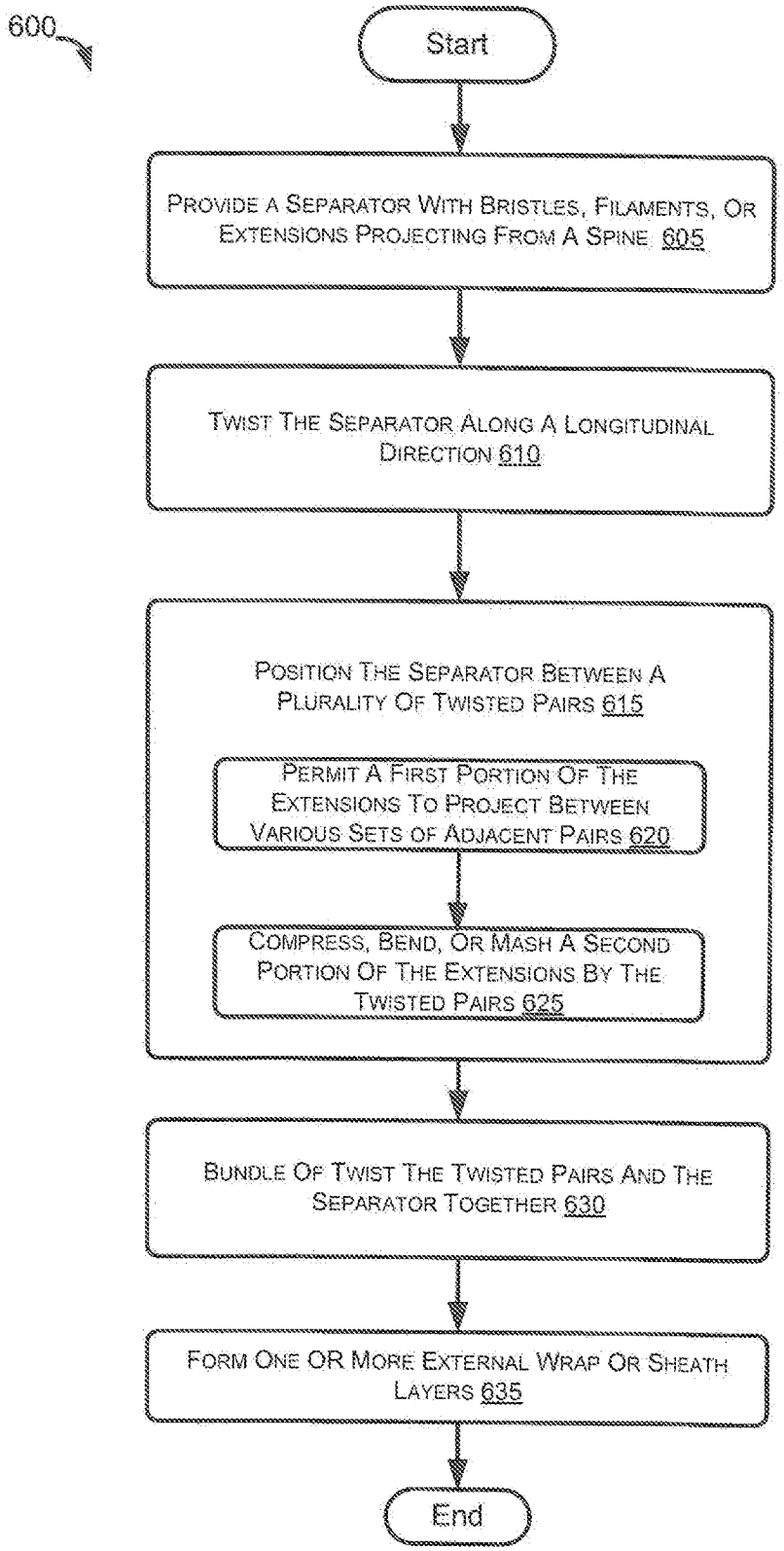
FIG. 6 is a flow chart of an example method for incorporating a separator into a cable, according to an illustrative embodiment of the disclosure.

FIG. 6 is a flow chart of an example method 600 for incorporating a separator including a plurality of bristles into a cable, according to an illustrative embodiment of the disclosure. The method 600 may begin at block 605. At block 605, a separator having a plurality of bristles, filaments, or extensions projecting from a spine may be provided. As explained in greater detail above, bristles may extend from the spine in a wide variety of suitable configurations, patterns, and/or other suitable arrangements. Additionally, the various components of the separator may be formed from a wide variety of suitable materials and/or with a wide variety of suitable dimensions.

In certain embodiments, the separator may be provided one or more suitable sources, such as a payoff, reel, bin, or other suitable component that functions to payout or otherwise provide the separator downstream to other components of a system. In other embodiments, the separator may be provided in an in-line manner from one or more devices that manufacture or assemble the separator. Additionally, one or more of the twisted pairs may be provided from one or more suitable sources or in an in-line manner. In certain embodiments, the twisted pairs and the separator may be fed to a suitable accumulation point where the separator is positioned between the twisted pairs.

At block 610, which may be optional in certain embodiments, the separator may be longitudinal twisted. As a result of longitudinally twisting the separator, the direction of extension of the bristles may be varied along a longitudinal length of the separator. For example, a spiral pattern of bristles may be formed. Additionally, any suitable twist rates and/or twist direction may be utilized as desired. A wide variety of suitable twisting devices may be utilized to longitudinally twist the separator and/or the spine prior to the separator being positioned proximate to the twisted pairs. In certain embodiments, back tension supplied by the source and/or other devices may work in conjunction with the twisting device(s) to longitudinally twist the separator.

At block 615 the separator may be positioned between a plurality of twisted pairs, and the twisted pairs may be brought into proximity with the separator. As set forth above, a first portion of the bristles may extend between adjacent sets of twisted pairs while a second portion of the bristles are compressed by one or more twisted pairs. For example, at block 620, when the separator is positioned between the plurality of twisted pairs, a first portion of the bristles or extension may be permitted or allowed to project between various sets of adjacent twisted pairs. At block 625, a second portion of the bristles or extensions may be compressed, bent, or mashed by one or more of the twisted pairs. For example, the second portion may be compressed towards the spine of the separator.

At block 630, the twisted pairs and the separator may be helically twisted and/or bunched together. In other words, an overall twist lay or bunch lay may be applied to the collective plurality of twisted pairs and the separator. One or more suitable sheath layers, such as a shield layer, outer jacket, or other external wrap may then be formed around the twisted pairs and the separator at block 635. Any number of suitable devices may be utilized to form an outer wrap around the twisted pairs and the separator. For example, one or more suitable extrusion devices may be utilized to extrude a jacket around the twisted pairs and the separator. As another example, one or more suitable dies and/or wrapping devices may be utilized to form a shield or other suitable layer around the twisted pairs and the separator. In the event that a shield or other wrap is formed, a jacket may subsequently be formed as desired in certain embodiments. One or more finishing operations, such as take-up of the cable or provision of the cable to one or more downstream devices, may then occur. The method 600 may end following block 635.

As desired in various embodiments, the method 600 may include more or less operations than those described above with reference to FIG. 6. For example, portions of a bristles that extend beyond an outer periphery of the twisted pairs may be wrapped or curled around the outer periphery.

Additionally, in certain embodiments, any number of the described operations may be carried out or performed in parallel. The described method 600 is provided by way of non-limiting example only.

Conditional language, such as, among others, "can," "could," "might," or "may," unless specifically stated otherwise, or otherwise understood within the context as used, is generally intended to convey that certain embodiments could include, while other embodiments do not include, certain features, elements, and/or operations. Thus, such conditional language is not generally intended to imply that features, elements, and/or operations are in any way required for one or more embodiments or that one or more embodiments necessarily include logic for deciding, with or without user input or prompting, whether these features, elements, and/or operations are included or are to be performed in any particular embodiment.

Many modifications and other embodiments of the disclosure set forth herein will be apparent having the benefit of the teachings presented in the foregoing descriptions and the associated drawings. Therefore, it is to be understood that the disclosure is not to be limited to the specific embodiments disclosed and that modifications and other embodiments are intended to be included within the scope of the appended claims. Although specific terms are employed herein, they are used in a generic and descriptive sense only and not for purposes of limitation.

That which is claimed:

1. A cable comprising:

a plurality of twisted pairs of individually insulated electrical conductors that extend along a longitudinal direction;

a separator comprising:

a longitudinally extending spine positioned between the plurality of twisted pairs; and a plurality of bristles radially extending from the spine, wherein a first portion of the bristles extend between one or more sets of adjacent twisted pairs and a second portion of the bristles each respectively comprise a first end attached to the spine and a second end bent towards the spine by one or more of the plurality of twisted pairs; and a jacket formed around the twisted pairs and the separator.

2. The cable of claim 1, wherein, at a plurality of respective cross-sectional points along the longitudinal length of the spine, the plurality of bristles includes respective bristles extending in a plurality of different directions.

3. The cable of claim 1, wherein the plurality of bristles extend from the spine along its longitudinal length in a spiral pattern.

4. The cable of claim 3, wherein the spiral pattern has a lay length between approximately 0.1 inches and approximately 50.0 inches.

5. The cable of claim 1, wherein the plurality of bristles extend from the spine with a density between approximately 100 and approximately 650 bristles per square inch.

6. The cable of claim 1, wherein each of the plurality of bristles has a cross-sectional area between approximately $7.07\times10^{-6}$ square inches and approximately $5.03\times10^{-3}$ square inches.

7. The cable of claim 1, wherein each of the plurality of bristles extend from the spine with a length between approximately 0.03 inches and approximately 0.7 inches.

8. A cable comprising:

a plurality of twisted pairs of individually insulated electrical conductors that extend along a longitudinal direction;

a separator positioned between the plurality of twisted pairs, the separator comprising:

a longitudinally continuous central portion; and a plurality of extending portions that radially project from the central portion in a spaced arrangement along the longitudinal direction, wherein at least one of the extending portions extends between two of the plurality of twisted pairs and another one of the extending portions comprises a free end that is bent or folded towards the central portion by one or more of the plurality of twisted pairs; and a jacket formed around the twisted pairs and the separator.

9. The cable of claim 8, wherein, at a plurality of respective cross-sectional points along the longitudinal direction, the plurality of extending portions includes at least two extending portions that radially project from the central portion in different directions.

10. The cable of claim 8, wherein the plurality of extending portions project from the central portion in a spiral pattern along the longitudinal direction.

11. The cable of claim 8, wherein the plurality of extending portions project from the central portion with a density between approximately 100 and approximately 650 extending portions per square inch.

12. The cable of claim 8, wherein each of the plurality of extending portions has a cross-sectional area between approximately $7.07\times10^{-6}$ square inches and approximately $5.03\times10^{-3}$ square inches.

13. The cable of claim 8, wherein each of the plurality of extending portions project from the central portion with a length between approximately 0.03 inches and approximately 0.7 inches.

14. The cable of claim 8, wherein each of the extending portions comprises one of a fiber, filament, or bristle.

15. A cable comprising:

a plurality of twisted pairs of individually insulated electrical conductors that extend along a longitudinal direction;

a separator positioned between the plurality of twisted pairs, the separator comprising:

a longitudinally continuous central portion; and a plurality of fibers that radially extend from the central portion at a plurality of spaced locations along the longitudinal direction with a density between approximately 100 and approximately 650 fibers per square inch, wherein a first portion of the fibers respectively extend between adjacent twisted pairs included in the plurality of twisted pairs and a second portion of the fibers are bent or folded towards the central portion by one or more of the plurality of twisted pairs; and a jacket formed around the twisted pairs and the separator.

16. The cable of claim 15, wherein, at a plurality of respective cross-sectional points along the longitudinal length of the central portion, the plurality of fibers includes respective fibers extending in a plurality of different directions.

17. The cable of claim 15, wherein the plurality of fibers extend from the central portion along its longitudinal length in a spiral pattern.

18. The cable of claim 15, wherein each fiber included in the second portion comprises a free end that is bent towards the central portion.

19. The cable of claim 15, wherein each of the plurality of fibers has a cross-sectional area between approximately $7.07\times10^{-6}$ square inches and approximately $5.03\times10^{-3}$ square inches.

20. The cable of claim 15, wherein each of the plurality of fibers extend from the central portion with a length between approximately 0.03 inches and approximately 0.7 inches.

* * * * *